US005855373A

United States Patent [19]

Chen

[11] Patent Number: 5,855,373

[45] Date of Patent: Jan. 5, 1999

[54] EQUILIBRIUM GAME DEVICE

[75] Inventor: Wei-Ming Chen, Taipei, Taiwan

[73] Assignee: Lovetex Industrial Corp., Taipei, Taiwan

[21] Appl. No.: 969,281

[22] Filed: Nov. 13, 1997

[51] Int. Cl.[6] ..... A63F 3/00

[52] U.S. Cl. ..... 273/441; 273/DIG. 30

[58] Field of Search ..... 273/440, 441, 273/443, DIG. 30

[56] References Cited

U.S. PATENT DOCUMENTS

| | | | |
|---|---|---|---|
| 3,208,747 | 9/1965 | Kavakos | 273/441 |
| 3,829,088 | 8/1974 | Pahlas | 273/443 |
| 4,142,725 | 3/1979 | Gilbert et al. | 273/DIG. 30 |
| 4,248,422 | 2/1981 | Messina | 273/441 |
| 4,288,537 | 9/1981 | Knetzger | 273/441 X |
| 4,892,306 | 1/1990 | Kawar | 273/441 |
| 5,158,303 | 10/1992 | Lat | 273/441 |

*Primary Examiner*—William E. Stoll
*Attorney, Agent, or Firm*—Rosenberg, Klein & Bilker

[57] ABSTRACT

The invention herein relates to kind of improve equilibrium game device, specifically referring to a kind that has a game board with a linear motion slot that is a randomly non-collinear and of a varying width through which the player moves an equilibrium rod. The unique innovation of the invention herein is the attachment of a looped surfacing or a hooked surfacing on the contoured inner surfaces of the linear motion slot and the attachment of a looped surfacing or hooked surfacing to the outer aspect of the equilibrium rod, with the particular surfacing applied to the linear motion slot and on the equilibrium rod being of an opposite nature to produce snagging or frictional resistance upon mutual contact, such that the player is afforded a safe, simple and convenient means of practicing equilibrium by avoiding contact that would, due to engagement of the respective hooked and looped surfaces, prevent continued movement of the equilibrium rod through the linear motion slot.

3 Claims, 4 Drawing Sheets

EQUILIBRIUM GAME DEVICE

BACKGROUND OF THE INVENTION

As indicated in FIG. 1, conventional equilibrium games mainly consist of an irregularly curved metal rod frame (1) and a looped metal rod (2) that fits around and is movable along the horizontal length of the metal rod frame (1), wherein the aforesaid metal rod frame (1) is connected via a wire (3) to one pole of a battery (4) and the looped metal rod (2) is connected via a wire (3) to the other pole of the battery (4); after the switch (5) is controlled to allow for electrical conductance between the metal rod frame (1) and the looped metal rod (2), the player manually moves the looped metal rod (2) along the length of the metal rod frame (1) such that the looped metal rod (2) does not contact the metal rod frame (1) and if contact is imprudently established by the equilibrium game player, then the circuit is immediately closed and an audio signal is produced. Undeniably, the assembling of a equilibrium game device utilizing a looped metal rod, a metal rod frame, battery, switch and other components is an effective and workable method. However, following experience gained from usage, the inventor of the invention herein discovered that there were still a number of actual shortcomings that could be improved upon. Since such games require electricity supplied by a battery to effectively function, not only were the set up conditions inconvenient and of limited scope, but the battery consumption was not economical; furthermore, the forming and fabrication of the aforesaid metal rod frame and looped rod were cumbersome, troublesome and costly.

Therefore, the structure of the aforesaid equilibrium game device evidently still has existent shortcomings in terms of practicality and, furthermore, requires improvement.

SUMMARY OF THE INVENTION

The primary objective of the invention herein is to provide a kind of improved equilibrium game device, wherein the game board has a preconfigured linear motion slot which is a randomly non-collinear in form with contoured inner surfaces, to which are directly attached a looped surfacing or a hooked surfacing, and the player is provided with a manual equilibrium rod, to which is attached a looped surfacing or a hooked surfacing different from the type of surfacing in the linear motion slot of the game board such that when the loop surfacing contacts the hooked surfacing, adhesion is naturally produced by the engagement; the player then moves the equilibrium rod through and along the path of the linear motion slot in the game board and attempts to avoid the snagging and frictional resistance resulting when the looped surfacing touches the hooked surfacing.

Another objective of the invention herein is to provide a kind of improved equilibrium game device, wherein the aforesaid board and equilibrium rod can be constructed from any type of material and, furthermore, the respective attachment of the looped surfacing and the hooked surfacing involves a simple operation so the overall fabrication of the invention herein is effectively simple, convenient, economical and multifaceted, at the same time, the configuring of the aforesaid equilibrium game consists of the alternating and respective attachment of the looped surfacing and the hook surfacing to the linear motion slot of the game board and the equilibrium rod, and unlike conventional equilibrium game devices, does not require a battery and electrical conductance for operation; in terms of actual practicality, the invention herein is not subject to specific conditional limitations and, furthermore, effectively provides convenience in the process.

Yet another objective of the invention herein is to provide a kind of improved equilibrium game device that is structurally simple, easy to operate, not difficult to utilize, and convenient, but also enables the equilibrium game device to be more multifaceted, and economical and in actual application, ideal and progressive; furthermore, such an improved equilibrium game device is unavailable at present.

To enable the examination committee to further understand and recognize the objectives, innovations and functions of the invention herein, the brief description of the drawings below is followed by the detailed description of the invention herein.

DETAILED DESCRIPTION OF THE INVENTION

Figure 1:
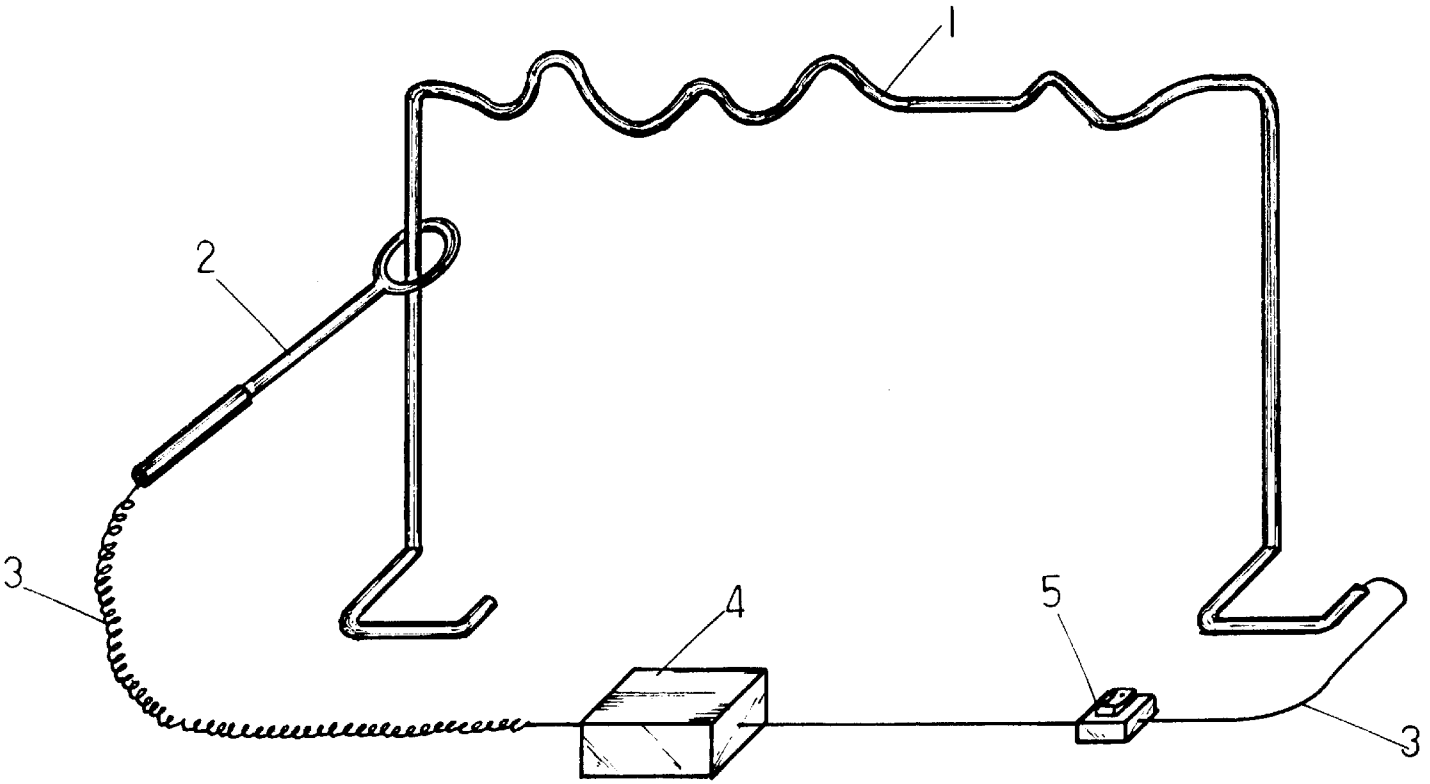
FIG. 1 (PRIOR ART)
FIG. 1 is an isometric drawing of a conventional balance game.
Figure 2:
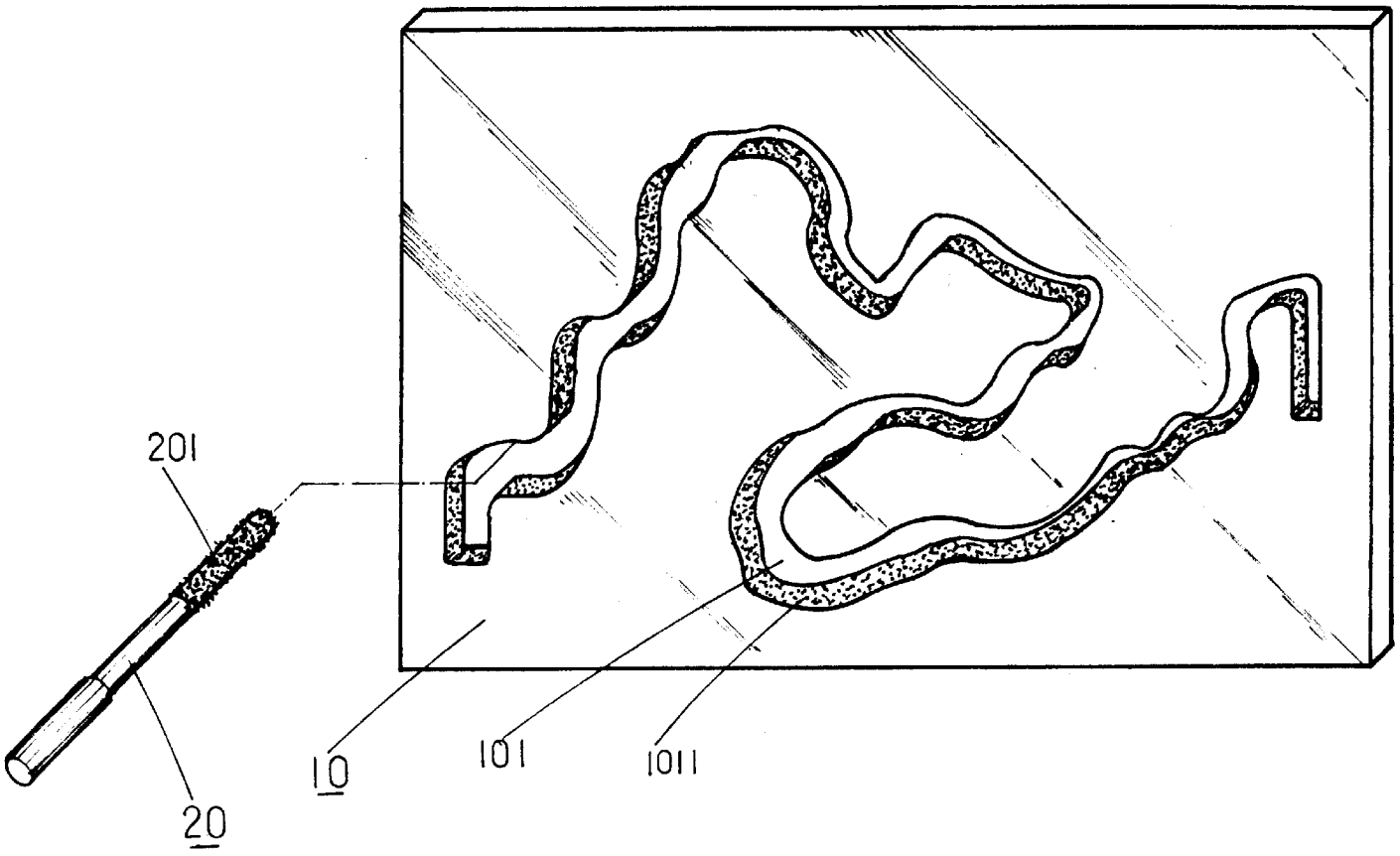
FIG. 2 is an isometric drawing of the invention herein.

Referring to FIG. 2, as clearly indicated the invention herein is a kind of improved equilibrium game device that mainly comprises a board (10) which can be constructed of any type of material; a linear motion slot (101) which as depicted in the drawing is randomly non-collinear and, furthermore, of a varying width, and attached to the contoured inner surfaces of the aforesaid linear motion slot (101) is a looped surfacing or hooked surfacing (1011); and an equilibrium rod (20) which can be constructed of any type of material such that the outer diameter of the tip is smaller than the narrowest width of the linear motion slot (101) in the board (10) and furthermore, the front end has a hooked surfacing or a looped surfacing (201) attached, with the exact type of surfacing utilized differing from the surfacing utilized in the linear motion slot (101) in the board (10).

As for the utilization of the aforementioned structure of the invention herein, when the equilibrium game device is played, the front end of the equilibrium rod (20) is manually extended into the linear motion slot (101) of the board (10) and, furthermore, moved along the varying path of the linear motion slot (101), during which time, mutual contact between the looped surfacing (1011) attached to the linear motion slot (101) of the board (10) and the hooked surfacing (201) attached to the equilibrium rod (20) naturally serve to produce snagging or frictional resistance along the path of movement, and the objective of playing the equilibrium game device is the avoidance of the aforesaid mutual contact by the player: of course, since the looped surfacing (1011) and the hooked surfacing (201) constituting the aforesaid equilibrium game device poses no danger whatsoever, therefore, the respective functions of the linear motion slot (101) of the board (10) and the equilibrium rod (20), in addition to ensuring greater player safety and interest also provides for simplicity, convenience, economical considerations and increased overall efficiency in equilibrium game device fabrication and utilization, which is a genuine improvement over the disadvantages of conventional devices that require metal materials as well as batteries and electrical conductance.

Figure 3:
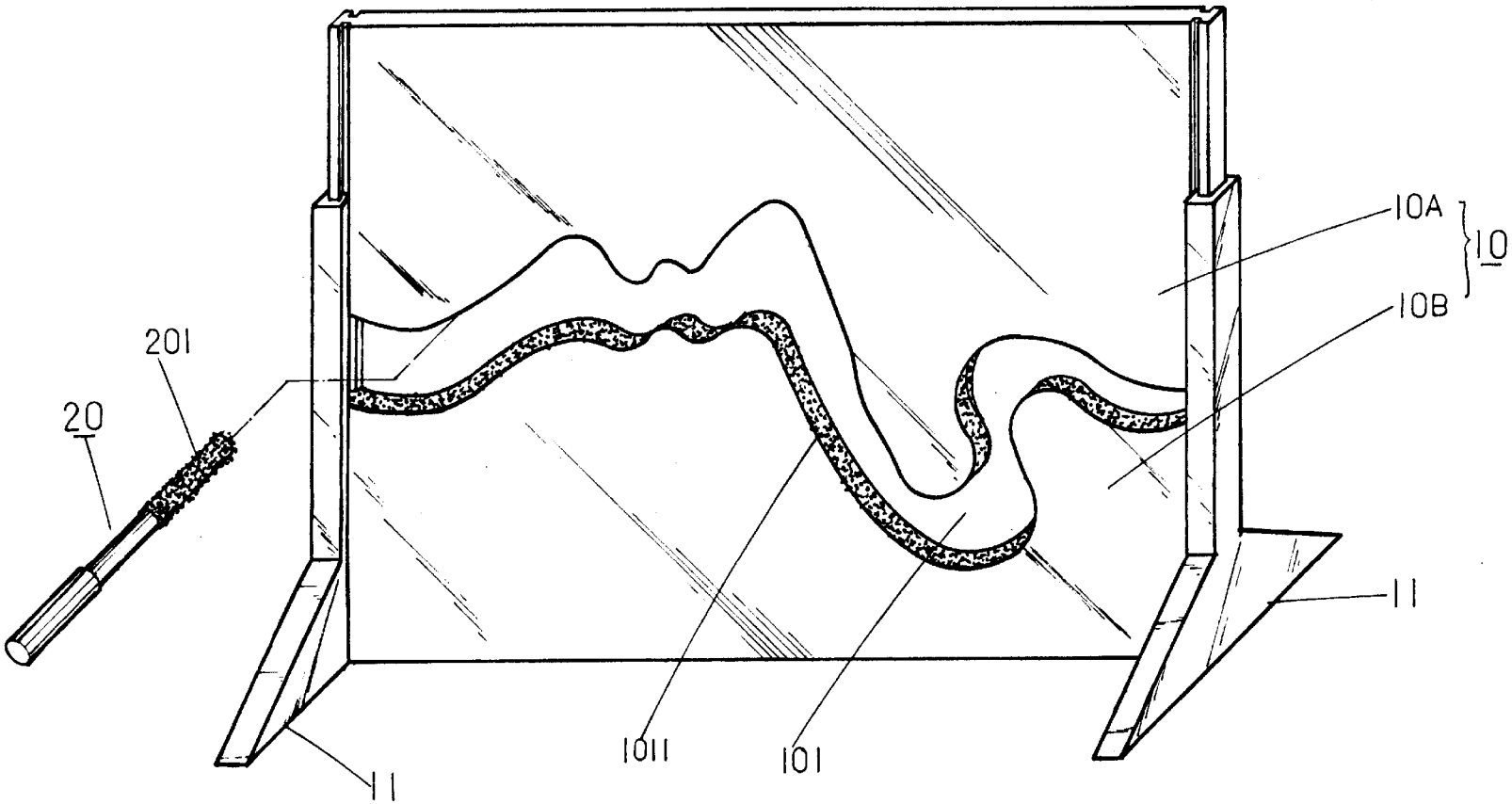
FIG. 3 is isometric drawing another embodiment of the invention herein.

Furthermore, referring to FIG. 3, the board (10) is divided into the two sections (10A) and (10B), with the line of separation following along the contours of the linear motion slot (101) and, furthermore, can be raised, lowered and secured edgewise at the two ends by mounting in a support frame (11), thereby enabling the width of the linear motion slot (101) to be adjusted as necessary by an upward or downward movement to accommodate players of different age levels, such that the actual embodiment of the equilibrium game device is entertaining, features an expanded scope of application and is effectively multifaceted. The main purpose of integrating of the aforesaid board sections (10A) and (10B) with the support frame (11) is to facilitate the adjustment of the interval in between the facing edges of the board sections (10A) and (10B) by upward or downward movement and since there are numerous methods of integration possible such as locking or clamping and so on, such integration shall not be further elaborated, however, the adjustable linear motion slot (101) width in the board (1) effectively enhances the playability of the equilibrium game device herein.

Figure 4:
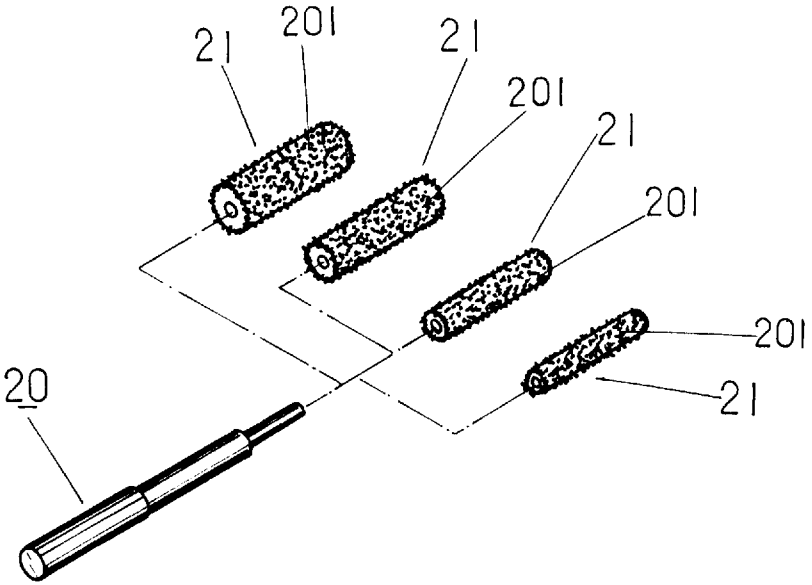
FIG. 4 is isometric drawing another embodiment of the equilibrium rod of the invention herein.

Referring to FIG. 4, the looped surfacing (1011) or hooked surfacing (201) attached to the front end of the equilibrium rod (20) can also be attached to sleeve heads (21) of different dimensions that are installable as interchangeable tubular assemblies onto the equilibrium rod (20), such that the adjustable linear motion slot (101) width of the board (1) does not require the aformentioned adjustment procedure to vary width size, which achieves the objective of accommodating players of different age levels.

However, the descriptions of the drawings only relate to the feasible embodiments of the invention herein and the adaptations of all persons familiar enough with the technology of the invention herein to modify or embellish the functions claimed in the spirit and scope of the invention herein such as the modification of a conventional metal support frame, the utilization of a non-metal columnar rod, the replacement of the looped surfacing or hooked surfacing attached to the facing surfaces for modification into an electrically configured equilibrium game device and other derivations shall be included under the following claims of the invention herein as submitted in application for the commensurate patent rights.

What is claimed is:

1. An equilibrium game device that includes and mainly comprises a board that has a linear motion slot which is a randomly non-collinear and, furthermore, of a varying width, and attached to the contoured inner surfaces of the aforesaid linear motion slot is a looped surfacing or a hooked surfacing; an equilibrium rod, of which the outer diameter of the tip is smaller than the narrowest width of the linear motion slot in the aforesaid board and, furthermore, the front end has a hooked surfacing or felt surfacing attached, with the exact type of surfacing utilized differing from the surfacing utilized in the aforesaid linear motion slot in the aforesaid board; and the utilization of the foregoing components completes the improved equilibrium game device herein.

2. The equilibrium game device of claim 1 wherein the aforementioned board is divided into two sections, with the line of separation following along the contours of the aforementioned linear motion slot and, furthermore, can be raised, lowered and secured edgewise at the two ends by mounting in a support frame, thereby enabling the width of the aforesaid linear motion slot to be adjusted as necessary by an upward or downward movement.

3. The equilibrium game device of claim 1 wherein the aforementioned looped surfacing or the aforementioned hooked surfacing attached to the front end of the aforementioned equilibrium rod can also be attached to sleeve heads of different dimensions that are installable as interchangeable tubular assemblies onto the aforesaid equilibrium rod.

* * * * *